US011089813B2

(12) United States Patent
Borkovec et al.

(10) Patent No.: US 11,089,813 B2
(45) Date of Patent: Aug. 17, 2021

(54) ELECTRONIC VAPING DEVICE WITH A PLURALITY OF HEATING ELEMENTS

(71) Applicant: Fontem Holdings 1 B.V., Amsterdam (NL)

(72) Inventors: Vaclav Borkovec, Hamburg (DE); Stefan Biel, Hamburg (DE)

(73) Assignee: Fontem Holdings 1 B.V., Amsterdam (NL)

( * ) Notice: Subject to any disclaimer, the term of this patent is extended or adjusted under 35 U.S.C. 154(b) by 521 days.

(21) Appl. No.: 16/070,231

(22) PCT Filed: Dec. 8, 2016

(86) PCT No.: PCT/EP2016/080210
§ 371 (c)(1),
(2) Date: Jul. 13, 2018

(87) PCT Pub. No.: WO2017/121546
PCT Pub. Date: Jul. 20, 2017

(65) Prior Publication Data

US 2019/0029321 A1 Jan. 31, 2019

(30) Foreign Application Priority Data

Jan. 15, 2016 (EP) ..... 16151486

(51) Int. Cl.
*A24F 47/00* (2020.01)
*A24F 1/30* (2006.01)
(Continued)

(52) U.S. Cl.
CPC ..... *A24F 1/30* (2013.01); *A24F 40/42* (2020.01); *A24F 40/46* (2020.01); *A24F 40/51* (2020.01);
(Continued)

(58) Field of Classification Search
CPC ..... A24F 40/46; A24F 47/008
See application file for complete search history.

(56) References Cited

U.S. PATENT DOCUMENTS 5,269,327 A 12/1993 Counts et al.
2014/0209105 A1 7/2014 Sears et al.
(Continued)

FOREIGN PATENT DOCUMENTS

CN 103653258 A 3/2014
CN 103783673 A 5/2014
(Continued)

*Primary Examiner* — Eric Yaary
(74) *Attorney, Agent, or Firm* — Dykema Gossett PLLC

(57) ABSTRACT

An electronic vaping device (10) includes a power supply portion (12) comprising a power supply (18), an atomizer/liquid reservoir portion (14) comprising a liquid reservoir (48) storing a liquid (30) in a free floating manner, and an atomizer (28) adapted to atomize the liquid (30) stored in the liquid reservoir (48) when operated by the power supply (18). The atomizer (28) includes a plurality of heating elements (36*a*, 36*b*, 36*c*, 36*d*, 36*e*) that are arranged inside the liquid reservoir (48) at different levels ($h_a$, $h_b$, $h_c$, $h_d$, $h_e$).

20 Claims, 4 Drawing Sheets

(51) Int. Cl.

| | |
|---|---|
| ***A24F 40/42*** | (2020.01) |
| ***A24F 40/46*** | (2020.01) |
| ***A24F 40/51*** | (2020.01) |
| ***H05B 1/02*** | (2006.01) |
| ***H05B 3/46*** | (2006.01) |
| *A24F 40/10* | (2020.01) |

(52) U.S. Cl.
CPC ..... *H05B 1/0297* (2013.01); *H05B 3/46* (2013.01); *A24F 40/10* (2020.01); *H05B 2203/021* (2013.01); *H05B 2203/036* (2013.01)

(56) References Cited

U.S. PATENT DOCUMENTS

| | | | | |
|---|---|---|---|---|
| 2015/0128968 | A1* | 5/2015 | Chapman | A24F 47/008 131/329 |
| 2015/0217068 | A1 | 8/2015 | Wakalopulos | |
| 2017/0020193 | A1* | 1/2017 | Davis | A61M 15/06 |
| 2017/0181223 | A1* | 6/2017 | Sur | H04L 67/42 |

FOREIGN PATENT DOCUMENTS

| | | | |
|---|---|---|---|
| CN | 203952448 | U | 11/2014 |
| CN | 204070498 | U | 1/2015 |
| CN | 204317492 | U | 5/2015 |
| CN | 105072935 | A | 11/2015 |
| EP | 2641490 | A1 | 9/2013 |
| GB | 2527597 | A | 12/2015 |

* cited by examiner

ELECTRONIC VAPING DEVICE WITH A PLURALITY OF HEATING ELEMENTS

FIELD OF INVENTION

The present invention relates generally to electronic vaping devices.

BACKGROUND OF THE INVENTION

An electronic vaping device, such as an electronic shisha or an electronic cigarette, typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic vaping devices, an airflow sensor is provided within the electronic vaping device, which detects a user puffing on the device (e.g., by sensing an under-pressure or an air flow pattern through the device). The airflow sensor indicates or signals the puff to the control electronics to power up the device and generate vapor. In other electronic vaping devices, a switch is used to power up the electronic vaping device to generate a puff of vapor.

In order to ensure constant operability of the electronic vaping device, the atomizer has to be reliably supplied with liquid to be vaporized.

SUMMARY OF THE INVENTION

In accordance with one aspect of the present invention there is provided an electronic vaping device including a power supply portion comprising a power supply, an atomizer/liquid reservoir portion comprising a liquid reservoir storing a liquid in a free floating manner, and an atomizer. The atomizer is adapted to atomize the liquid stored in the liquid reservoir when operated by the power supply. The atomizer includes a plurality of heating elements that are arranged inside the liquid reservoir at different levels.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Throughout the following, an electronic vaping device 10 will be exemplarily described with reference to an e-shisha.

However, the electronic vaping device 10 can be any electronic inhalation device which vaporizes a liquid, such as an electronic cigarette.

Figure 1:
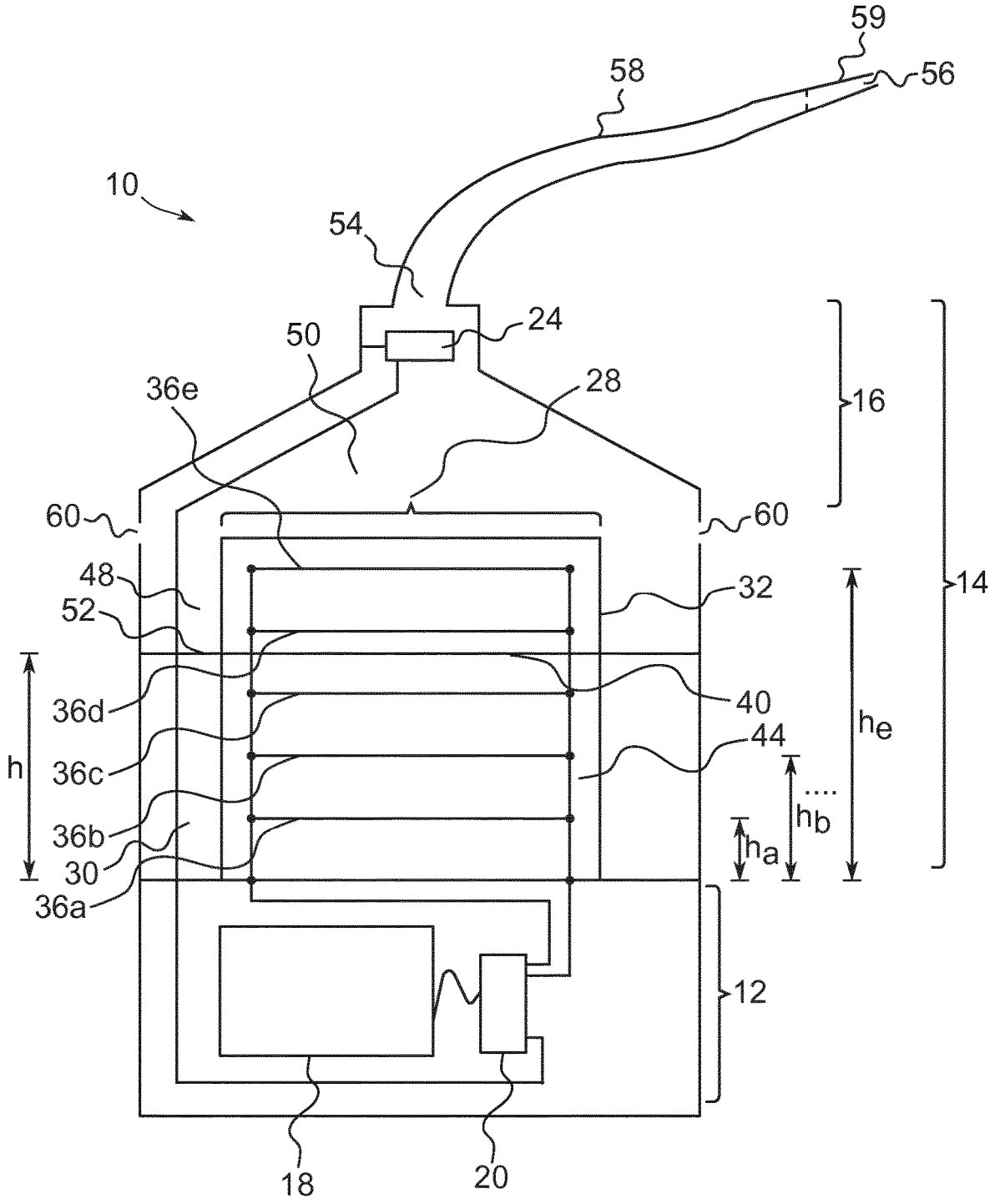
FIG. 1 is a schematic cross-sectional illustration of an exemplary electronic vaping device according to a first embodiment.

As is shown in FIG. 1, an electronic vaping device 10 typically has a housing comprising a cylindrical hollow tube having a tapering top portion 16. The cylindrical hollow tube may be a single-piece or a multiple-piece tube. In FIG. 1, the cylindrical hollow tube is shown as a two-piece structure having a power supply portion 12 as one piece and an atomizer/liquid reservoir portion 14 together with the tapering end portion 16 as the second piece.

The tapering end portion 16 may also be provided as a separate piece, having varying geometrical shapes, e.g. hemispherical. The power supply portion 12 may be provided in the end portion 16. The size of the housing as well as the specific geometry of the hollow tube portion may also vary. Typically, the housing has a diameter of about 50 to 200 mm and a total height of about 150 to 500 mm.

The power supply portion 12 and atomizer/liquid reservoir portion 14 are typically made of metal, e.g. steel or aluminum, ceramic, glass, or of hardwearing plastic and act together with the tapering end portion 16 to provide a housing to contain the components of the electronic vaping device 10. The power supply portion 12 and an atomizer/liquid reservoir portion 14 may be configured to fit together by a friction push fit, a snap fit, or a bayonet attachment, magnetic fit, or screw threads.

A battery 18 and control electronics 20 are provided within the cylindrical hollow tube power supply portion 12. An optional airflow sensor 24 is provided in the housing, in the vicinity of an opening 54 at the top end of the tapering end portion 16. The battery 18 is electrically connected to the control electronics 20, which are electrically connected to the airflow sensor 24.

The airflow sensor 24 acts as a puff detector, detecting a user puffing or sucking on a mouthpiece 59 of a flexible tube 58 that is arranged at the top end of the atomizer/liquid reservoir portion 14 of the electronic vaping device 10. By means of the flexible tube 58, an air inhalation port 56 for the user is provided. A suitable air inhalation port 56 can also be provided directly at the opening 54, i.e. the flexible tube 58 is optional (cf. FIG. 4). The airflow sensor 24 can be any suitable sensor for detecting changes in airflow or air pressure, such as a microphone switch including a deformable membrane which is caused to move by variations in air pressure. Alternatively the sensor may be a Hall element or an electro-mechanical sensor.

The control electronics 20 are also connected to an atomizer 28. In the example shown in FIG. 1, the atomizer 28, which is wickless, includes a plurality of heating elements 36*a*, 36*b*, 36*c*, 36*d*, 36*e*. The heating elements 36*a*, 36*b*, 36*c*, 36*d*, 36*e* are arranged in the liquid reservoir 48 at different levels $h_a$, $h_b$, $h_c$, $h_d$, $h_e$ with respect to the liquid level h of the liquid 30 stored in the liquid reservoir. Depending on the current liquid level h, at least some of the heating elements 36*a*, 36*b*, 36*c* are surrounded by the liquid 30, because their respective level is below the current liquid level h. The height difference between adjacent levels may essentially be constant, as shown in FIG. 1, or may vary, e.g. depending on the geometry of the liquid reservoir 48.

In the example shown in FIG. 1, the heating elements 36*a*, 36*b*, 36*c*, 36*d*, 36*e* are formed by heating wires. The atomizer 28 may alternatively use other forms of heating elements 36, such as ceramic heaters, or fiber or mesh material heaters. Nonresistance heating elements such as sonic, and piezo may also be used in the atomizer 28 in place of the heating wires.

The heating elements 36*a*, 36*b*, 36*c*, 36*d*, 36*e* are arranged according to an array having a plurality of rows. Each of the rows of the array is located at one of the different levels $h_a$, $h_b$, $h_c$, $h_d$, $h_e$, i.e. each row represents one of the different levels $h_a$, $h_b$, $h_c$, $h_d$, $h_e$.

Generally, the heating elements 36*a*, 36*b*, 36*c*, 36*d*, 36*e* are formed from a conductive material that is selectively deposited onto a suitable substrate 32. The heating elements 36*a*, 36*b*, 36*c*, 36*d*, 36*e* can in particular be formed from metal or from a metallic material, as it is the case for the heating wires 36*a*, 36*b*, 36*c*, 36*d*, 36*e*. The substrate 32 is at least partly submerged into the liquid 30 in the liquid reservoir 48. Consequently, as already mentioned above, dependent on the current level h of the liquid 30 in the liquid reservoir 48, at least some of the heating elements 36*a*, 36*b*, 36*c* are surrounded by liquid 30.

In the example shown in FIG. 1, the substrate 32 is a sheet-like silicon-based substrate. Alternative materials can be used in order to form the substrate, as long as the respective material is sufficiently resistant to the temperature generated by the heating elements 36*a*, 36*b*, 36*c*, 36*d*, 36*e*. The conductive material, which forms the heating elements 36*a*, 36*b*, 36*c*, 36*d*, 36*e*, is preferably printed on the substrate 32. In this way, the atomizer 28 can be produced at low cost. Alternative deposition methods can be used to deposit the conductive structures forming the heating elements on the substrate.

As already indicated above, an air inhalation port 56 is provided at the end of a flexible tube 58 that is connected to the top end of the atomizer/liquid reservoir portion 14 in the area of the opening 54.

In use, a user sucks on the electronic vaping device 10, i.e. on the air inhalation port 56. This causes air to be drawn into the electronic vaping device 10 via one or more air inlets, such as air inlets 60 provided in the side wall of the atomizer/liquid reservoir portion 14, and to be drawn through the vaping chamber 50 towards the air inhalation port 56. The change in air pressure which arises is detected by the airflow sensor 24, which generates an electrical signal that is passed to the control electronics 20. In response to the signal, the control electronics 20 activate the heating wires 36, which causes liquid present around the heating wires 36 to be vaporized creating an aerosol (which may comprise gaseous and liquid components) within the vaping chamber 50. As the user continues to suck on the mouthpiece 59 of the electronic vaping device 10, this aerosol is drawn through the flexible tube 58 and inhaled by the user. Due to the fact that the heating elements 36*a*, 36*b*, 36*c*, 36*d*, 36*e* are arranged at different levels $h_a$, $h_b$, $h_c$, $h_d$, $h_e$ in the liquid reservoir 48, at least one of the heating elements 36*a*, 36*b*, 36*c* is in contact with the liquid 30 in the liquid reservoir 48, and liquid 30 is constantly available to be converted into an aerosol through subsequent activation of the heating wires 36.

Preferably, the control electronics 20 are configured to selectively operate one or more individual heating elements of the plurality of heating elements 36*a*, 36*b*, 36*c*, 36*d*, 36*e*. With respect to the embodiment according to FIG. 1, the control electronics can e.g. be configured to operate each of the heating wires 36*a*, 36*b*, 36*c*, 36*d*, 36*e* separately.

The electronic vaping device 10 may further comprise a liquid level sensing element connected to the control electronics 20. The control electronics 20 are then configured to determine a current liquid level h of the liquid 30 stored in the liquid reservoir 48 by means of the liquid level sensing element. According to an embodiment, liquid level sensing can be done mechanically, via a floating switch which floats on top of the liquid reservoir.

According to a preferred embodiment, the liquid level sensing element can be formed by the plurality of heating elements 36*a*, 36*b*, 36*c*, 36*d*, 36*e*. In this case, the control electronics 20 is configured to determine whether or not a specific heating element 36*a*, 36*b*, 36*c*, 36*d*, 36*e* is currently submerged into the liquid 30, and based on this information and the location of the respective heating element inside the liquid reservoir 48, to determine the current liquid level h.

There are several ways this can be done. According to a first variant, some small percentage of water is added to the liquid, so that there is enough electrical conductivity to sense the presence of water across two conductive points, i.e. two heating elements. According to a second variant, a heating element can be activated and a resulting change in resistance due to heating it up can be measured. If the heating element is not immersed, it will heat up very fast rather than much slower in the presence of liquid around the heating element, i.e. in an immersed state. With this variant, one or more preferably small purpose built heating elements can be used at different levels, e.g. in each row of a respective heating element array. Alternatively, heating elements can be used that are made from a material with a measurable temperature-resistance relationship. In this case, the specific size and shape of the heating element is not a limiting feature.

Once the current liquid level h is determined, the control electronics 20 can operate one or more individual heating elements 36*a*, 36*b*, 36*c*, 36*d*, 36*e* based on their location with respect to the current liquid level h of the liquid 30 stored in the liquid reservoir. In particular, it can be avoided that heating elements 36*d*, 36*e* are operated that are no longer surrounded by liquid 30. Consequently, less energy in required compared to the case in which all heating elements are operated.

Further, in order to generate enough vapor, it is generally sufficient to only operate a heating element 36*c* that is, on the one hand, still surrounded by liquid 30, and, on the other hand, close to the surface 52 of the liquid 30. That is, it is generally not necessary to also operate the heating elements 36*a*, 36*b* that are arranged deep under the liquid surface 52. In the example shown in FIG. 1, the heating element 36*c* is both surrounded by liquid 30 and close to a vaping chamber 50 above the liquid surface 52. Therefore, aerosol generated by operating the heating element 36*c* does not get cooled so fast compared aerosol that is generated by a heating element 36*a*, 36*b* that is arranged deep under the liquid surface 52. As a consequence, in case only the heating element 36*c* is operated, sufficient vapor can be generated with less energy required. Further, following the above-described approach, independent of the current liquid level h, the amount of vapor generated per operation of the atomizer 28 can be kept essentially constant.

Typically, the battery 18 is rechargeable and the liquid reservoir 48 is refillable. In other embodiments the atomizer/liquid reservoir portion 14 of the electronic vaping device 10 is detachable from the power supply portion 12 and a new atomizer/liquid reservoir portion 14 can be fitted with a new liquid reservoir 48 thereby replenishing the supply of liquid. In some cases, replacing the liquid reservoir 48 may involve replacement of the atomizer 28 along with the replacement of the liquid reservoir 48. According to a preferred embodiment, the atomizer 28 is provided separate from the liquid reservoir 48 and is replaced if required, independent of refill or replacement of the liquid reservoir 48.

Of course, in addition to the above description of the structure and function of a typical electronic vaping device 10, variations also exist. The airflow sensor 24 may be placed somewhere inside the vapor chamber 50, e.g. in the vicinity of the air inlets 60. The airflow sensor 24 may be replaced with a switch or push button which enables a user to activate the electronic vaping device manually rather than in response to the detection of a change in air flow or air pressure.

Figure 2:
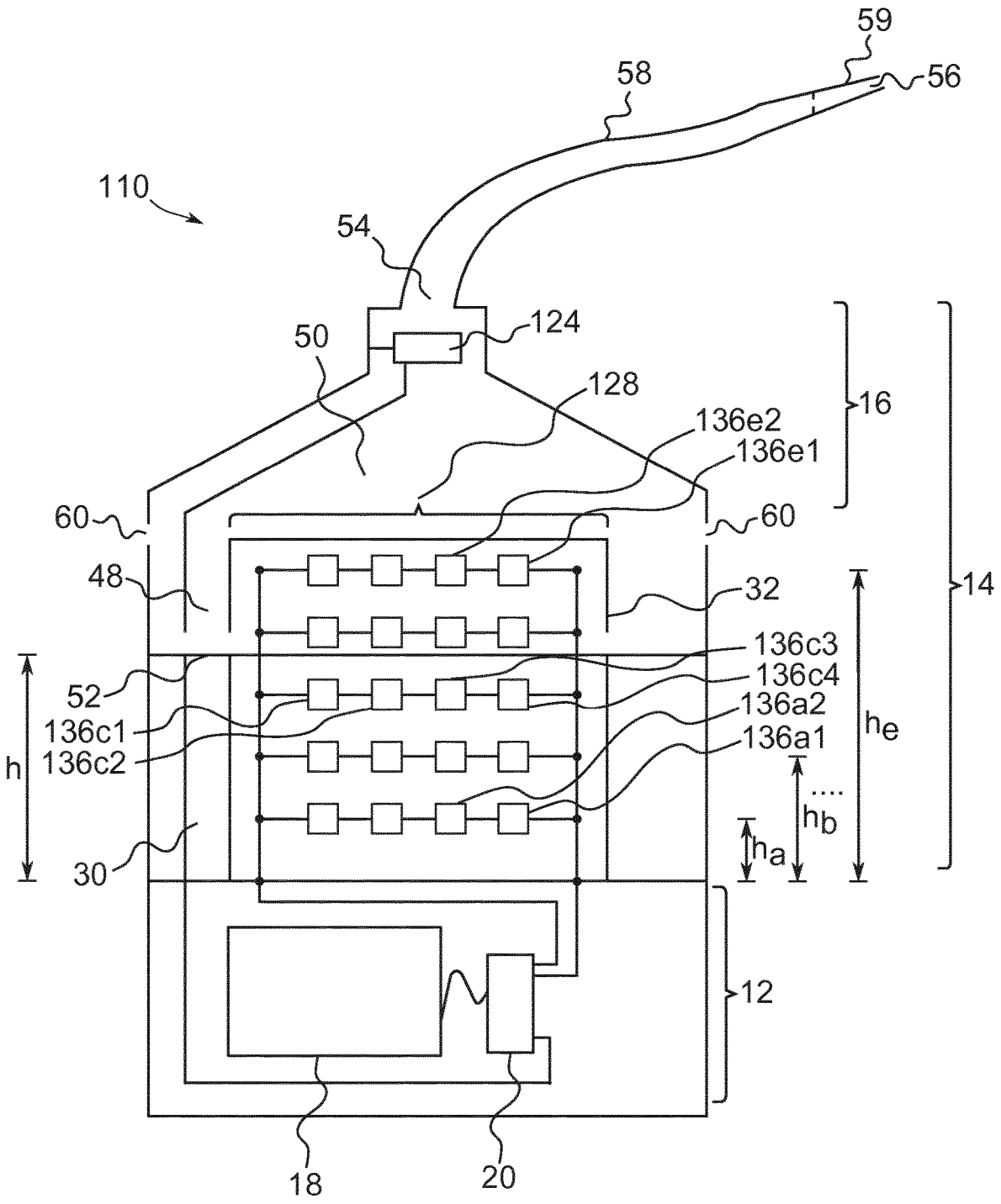
FIG. 2 is a schematic cross-sectional illustration of an exemplary electronic vaping device according to a second embodiment.

In FIG. 2, a vaping device 110 according to a second embodiment is shown. In contrast to the embodiment discussed with reference to FIG. 1, in the atomizer 128, not only one, but a plurality of heating elements 136$a_1$, 136$a_2$ is arranged in each row of the array according to which the plurality of heating elements are arranged on the substrate 32. The number of heating elements per row is constant in the embodiment shown in FIG. 2. However, it is also possible to provide a varying number of heating elements in different rows. Again, each of the heating elements can be selectively operated by the control electronics 20. In particular, the control electronics are configured to simultaneously activate a variable number of heating element in a given row. Instead of heating wires, one or more of the above mentioned alternative heating element types can be used to form the heating elements 136. According to this embodiment, there are heating elements at different levels of the liquid reservoir, irrespective of a specific or predefined orientation of the liquid reservoir.

In order to achieve this effect in general, it is sufficient to provide an atomizer that includes a plurality of heating elements that are arranged along at least two different spatial directions, e.g. a horizontal direction and a vertical direction, at regular or irregular intervals.

Figure 3:
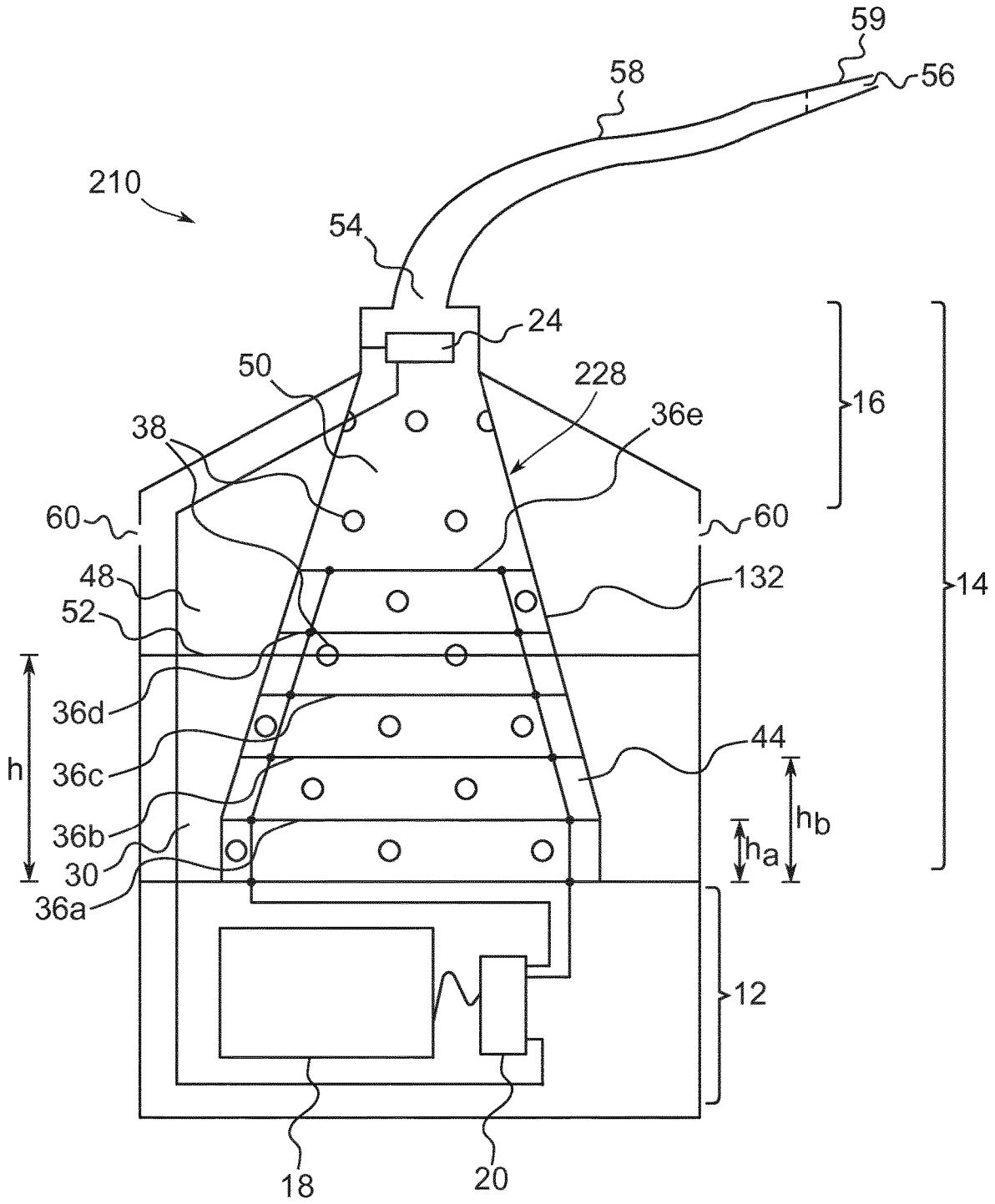
FIG. 3 is a schematic cross-sectional illustration of an exemplary electronic vaping device according to a third embodiment.

As described below, this feature, in combination with a specific puff sensor 124, can be used to adapt the amount of vapour that is generated per puff to a intensity of a puff. To this end, the airflow sensor 124 is configured to detect a pressure drop in the electronic vaping device 110 and to provide a pressure drop signal to the control electronics 20 that includes an intensity information specifying the intensity of the pressure drop. The control electronics 20, in turn, are configured to determine the intensity of the pressure drop based on the received pressure drop signal and to determine a number of heating elements to be simultaneously operated based on the intensity of the pressure drop. The pressure drop signal can e.g. be obtained by an analogue to digital conversion of a flow rate detected by the puff sensor as analogue signal. In the example shown in FIG. 2, in response to a light puff, which causes the puff sensor 124 to send a pressure drop signal specifying a low pressure drop, the control electronics 20 would e.g. only activate one of the heating elements in row c, e.g. heating element 136$c_1$. In response, however, to a heavy puff that causes a considerable pressure drop, the puff sensor 124 would send a respective pressure drop signal specifying the heavy pressure drop to the control electronics 20, which would, in order to generate an adequate amount of vapour, operate e.g. three or four of the heating elements 136$c_1$, 136$c_2$, 136$c_3$, 136$c_4$. In this way, an undesirable production of carbonyls can be prevented. Carbonyls are undesirable by-products found in aerosol generated by an electronic vaping device, which are formed by the thermal degradation of the liquid. Carbonyls are due to overheating small portions of the liquid being vaporised due to insufficient liquid feed and therefore excessive power/temperature. The more power is delivered to a heating element, the more carbonyls are expected in the aerosol. For vaping devices that have variable vapour production (typically called variable voltage/wattage devices) and a single heating element, e.g. a single or double coil, increasing the vapour production by increasing the power supply to the heating element usually results in an increase in carbonyl formation. In order to increase vapour production without increasing the formation of carbonyls, preferably a plurality of heating elements is activated by moderately supplying power to these heating elements rather than increasing the power that is delivered to a single heating element, because thereby the liquid is essentially kept within the same temperature range. In FIG. 3, a vaping device 210 according to a third embodiment is shown. This embodiment resembles the embodiment of FIG. 1 with respect to the array of heating elements. Again, a plurality of heating elements 36*a*, 36*b*, 36*c*, 36*d*, 36*e* are provided at different levels, and the heating elements are formed as metal heating wires 36*a*, 36*b*, 36*c*, 36*d*, 36*e* deposited on a sheet-like substrate 132.

In contrast to the embodiment of FIG. 1, the substrate 132 according to FIG. 3, in addition to carrying the heating elements, is configured to form at least part of an air flow channel through which aerosol generated by the heating elements 36*a*, 36*b*, 36*c*, 36*d*, 36*e* of the atomizer 228 can be drawn by a user of the electronic vaping device 210. In other words, the substrate 132 can e.g. form some kind of dome or tube inside the liquid reservoir 48, e.g. by suitably rolling up the sheet-like substrate 132. In this case, the heating elements 36*a*, 36*b*, 36*c*, 36*d*, 36*e* are arranged on the inner surface of the substrate 132, so that vapour generated by operating the heating elements essentially remains inside the dome or tube formed by the substrate 132, which dome or tube forms part of the air flow channel, and can therefore be easily drawn through the flexible tube 58 and inhaled by the user. In order to allow enough air to be drawn through the air flow channel formed by the substrate 132, the substrate 132 may be perforated and/or provided with air inlets 38, so that air to be drawn through the outer air inlets 60 can enter the air flow channel. In addition, in the embodiment according to FIG. 3, the air inlets 38 also serve as liquid inlets allowing liquid 30 to enter the area in the liquid reservoir 48, which area is surrounded or encased by the substrate 132. Additionally or alternatively, respectively perforated regions of the substrate 132 can allow liquid to enter. Alternatively, the air inlets 38 can only be provided in the upper portion of the substrate 132, above the liquid level h, and the lower portion of the substrate 132 can form a liquid reservoir storing the liquid 30.

Needless to say that the substrate 132 according to FIG. 3 could also carry a heating element array as described with respect to FIG. 2.

Figure 4:
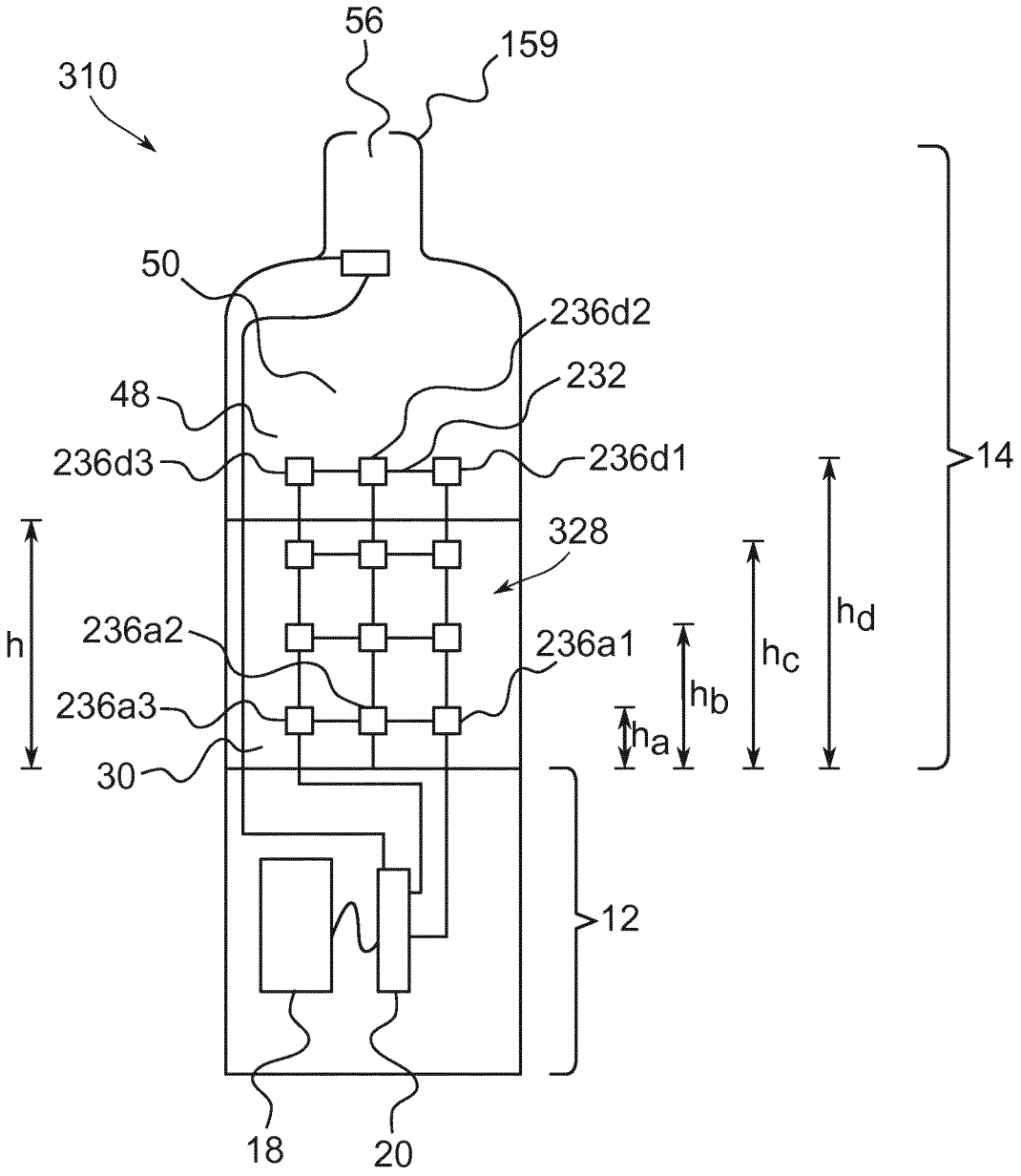
FIG. 4 is a schematic cross-sectional illustration of an exemplary electronic vaping device according to a fourth embodiment.

In FIG. 4, a fourth embodiment of a vaping device 310 is shown. The geometry of the vaping device 310, which is essentially rod-shaped, slightly differs from the geometry of the vaping devices 10, 110, 210 in FIGS. 1, 2, and 3, because the vaping device 310 is intended to be used one-handedly, i.e. by only using a single hand. There is no flexible tube 58 at the top end of the atomizer/liquid reservoir portion 14, where a respective mouthpiece 159 providing an inhalation port 56 is directly located. This design choice, however, does not influence the general function of the respective electronic vaping device 310 when a user puffs on the vaping device, which function has already been described in detail with respect to FIGS. 1 and 2.

In contrast to the embodiments described with respect to FIGS. 1 to 3, according to FIG. 4, the plurality of heating elements 236 are not provided on a sheet-like substrate, but a grid-like substrate 232 is used to support the heating elements 236. The respective grid can extend in one, two, or three dimensions. The grid can be regular, as shown in FIG.

4, or irregular. Providing a grid-like support structure has the advantage that the heating elements 236 are essentially completely surrounded by liquid 30. Apparently, the atomizer 328 including the grid-like substrate 232 could also be used in the context of an electronic vaping device having the design and geometry of one of the embodiments in FIGS. 1 to 3.

In summary, in one aspect the electronic vaping device has a power supply portion comprising a power supply, an atomizer/liquid reservoir portion comprising a liquid reservoir storing a liquid in a free floating manner, and an atomizer adapted to atomize the liquid stored in the liquid reservoir when operated by the power supply. The atomizer, in order to atomize the liquid, includes a plurality of heating elements that are arranged inside the liquid reservoir at different levels.

According to an embodiment, the heating elements are arranged according to an array having a plurality of rows. Each of the rows can be located at one of the different levels. According to a variant, a plurality of heating elements can be arranged in one row of the array. The number of heating elements per row can vary.

According to an embodiment, the heating elements are formed from a conductive material that is selectively deposited onto a substrate. The substrate is at least partly submerged into the liquid in the liquid reservoir. That is, dependent on the current liquid level, at least some of the heating elements are surrounded by liquid.

According to a variant, the heating elements are formed from metal or a metallic material.

According to a variant, the substrate is a silicon-based substrate.

According to a variant, the conductive material is printed on the substrate.

According to a variant, the substrate is configured to form at least part of an air flow channel through which aerosol generated by the atomizer can be drawn by a user of the electronic vaping device.

According to an embodiment, the electronic vaping device further comprises control electronics controlling the operation of the atomizer. The control electronics are configured to selectively operate one or more individual heating elements of the plurality of heating elements.

According to an embodiment, the electronic vaping device further comprises a liquid level sensing element connected to the control electronics. The control electronics are configured to determine a liquid level of the liquid stored in the liquid reservoir by means of the liquid level sensing element. According to a variant, the liquid sensing element is formed by the plurality of heating elements.

According to an embodiment, the control electronics are configured to operate one or more individual heating elements based on their location with respect to the current liquid level of the liquid stored in the liquid reservoir.

According to an embodiment, the electronic vaping device further comprises an airflow sensor connected to the control electronics. The airflow sensor is configured to detect a pressure drop in the electronic vaping device and to provide a pressure drop signal to the control electronics that includes an intensity information specifying the intensity of the pressure drop. The control electronics are configured to determine the intensity of the pressure drop based on the pressure drop signal and to determine a number of heating elements to be simultaneously operated based on the intensity of the pressure drop.

According to a second aspect, an atomizer/liquid reservoir portion for an electronic vaping device is provided including a liquid reservoir storing a liquid in a free floating manner and an atomizer adapted to atomize the liquid stored in the liquid reservoir when operated by a power supply of the electronic vaping device. The atomizer, in order to atomize the liquid, includes a plurality of heating elements that are arranged inside the liquid reservoir at different levels.

According to a variant, the plurality of heating elements is arranged according to an array having a plurality of rows, wherein a plurality of heating elements can be arranged in one row of the array.

According to an embodiment, the heating elements are formed from a conductive material that is selectively deposited onto a substrate, which substrate is at least partly submerged into the liquid in the liquid reservoir.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

| LIST OF REFERENCE SIGNS | |
|---|---|
| 10, 110, 210, 310, 41 | electronic vaping device |
| 12 | power supply portion |
| 14 | atomizer/liquid reservoir portion |
| 16 | tapering end portion |
| 18 | battery |
| 20 | control electronics |
| 24, 124 | airflow sensor |
| 28, 128, 228, 328 | atomizer |
| 30 | liquid |
| 32, 132, 232 | substrate |
| 36a, 36b, 36c, 36d, 36e, $136a_1$, $136a_2$, $136a_3$, $136e_1$, $136e_2$, $136c_1$, $136c_2$, $136c_3$, $136c_4$, $236a_1$, $236a_2$, $236a_3$, $236d_1$, $236d_2$, $236d_3$ | heating element |
| 38 | air/liquid inlet |
| 48 | liquid reservoir |
| 50 | vaping chamber |
| 52 | liquid surface |
| 54 | opening |
| 56 | air inhalation port |
| 58 | flexible tube |
| 59, 159 | mouthpiece |
| 60 | air inlets |
| h | liquid level |
| $h_a$, $h_b$, $h_c$, $h_d$, $h_e$ | different levels |

The invention claimed is:

1. An electronic vaping device comprising:

a power supply portion including a power supply;

an atomizer/liquid reservoir portion including a liquid reservoir configured to store a liquid in a free floating manner, and an atomizer configured to atomize the liquid stored in the liquid reservoir when operated by the power supply, wherein the atomizer includes a plurality of heating elements that are arranged inside the liquid reservoir at different levels;

control electronics configured to control operation of the atomizer by selectively operating one or more individual heating elements of the plurality of heating elements; and a liquid level sensing element communicatively coupled to the control electronics, wherein the control electronics are configured to determine a liquid level of the liquid stored in the liquid reservoir based on a signal received from the liquid level sensing element indicative of the liquid level in the liquid reservoir, and wherein the liquid sensing element is formed by the plurality of heating elements.

2. The electronic vaping device according to claim 1, wherein the heating elements are arranged in an array including a plurality of rows.

3. The electronic vaping device according to claim 2, wherein at least one of the plurality of rows of the array includes more than one of the plurality of heating elements.

4. The electronic vaping device according to claim 1, wherein the heating elements are formed from a conductive material selectively deposited onto a substrate, and the substrate is configured to be at least partly submerged into the liquid in the liquid reservoir.

5. The electronic vaping device according to claim 4, wherein the heating elements are formed from metal or a metallic material.

6. The electronic vaping device according to claim 4, wherein the substrate is a silicon-based substrate.

7. The electronic vaping device according to claim 4, wherein the conductive material is printed on the substrate.

8. The electronic vaping device according to claim 4, wherein the substrate is configured to form at least part of an air flow channel through which aerosol generated by the atomizer can be drawn.

9. The electronic vaping device according to claim 1, wherein the control electronics are further configured to operate one or more of the plurality of heating elements based on a location of the heating elements with respect to a current liquid level of the liquid stored in the liquid reservoir.

10. An electronic vaping device comprising:

a power supply portion including a power supply;

an atomizer/liquid reservoir portion including a liquid reservoir configured to store a liquid in a free floating manner, and an atomizer configured to atomize the liquid stored in the liquid reservoir when operated by the power supply, wherein the atomizer includes a plurality of heating elements that are arranged inside the liquid reservoir at different levels;

control electronics configured to control operation of the atomizer by selectively operating one or more individual heating elements of the plurality of heating elements; and an airflow sensor communicatively coupled to the control electronics, wherein the airflow sensor is configured to detect a pressure drop in the electronic vaping device and to provide a pressure drop signal to the control electronics indicative of an intensity of the pressure drop, and wherein the control electronics are further configured to determine the intensity of the pressure drop based on the pressure drop signal and to determine a number of heating elements to be simultaneously operated based on the intensity of the pressure drop.

11. An atomizer/liquid reservoir portion for an electronic vaping device comprising:

a liquid reservoir configured to store a liquid in a free floating manner; and an atomizer configured to atomize the liquid stored in the liquid reservoir when operated by a power supply of the electronic vaping device, wherein the atomizer includes a plurality of heating elements that are arranged inside the liquid reservoir in an array including a plurality of rows, and wherein one or more of the plurality of heating elements is configured to operate based on a location of the heating elements with respect to a current liquid level of the liquid stored in the liquid reservoir.

12. The atomizer/liquid reservoir portion according to claim 11, wherein the heating elements are formed from a conductive material that is selectively deposited onto a substrate that is configured to be at least partly submerged into the liquid in the liquid reservoir.

13. The electronic vaping device according to claim 12, wherein the substrate is a silicon-based substrate.

14. The electronic vaping device according to claim 12, wherein the conductive material is printed on the substrate.

15. The electronic vaping device according to claim 13, wherein the conductive material is printed on the substrate.

16. The electronic vaping device according to claim 12, wherein the substrate is configured to form at least part of an air flow channel through which aerosol generated by the atomizer can be drawn.

17. The electronic vaping device according to claim 13, wherein the substrate is configured to form at least part of an air flow channel through which aerosol generated by the atomizer can be drawn.

18. The electronic vaping device according to claim 10, wherein the control electronics are further configured to increase the number of heating elements simultaneously operated when the intensity of the pressure drop increases.

19. The electronic vaping device according to claim 10, wherein the heating elements are formed from a conductive material selectively deposited onto a substrate, and the substrate is configured to be at least partly submerged into the liquid in the liquid reservoir.

20. The electronic vaping device according to claim 19, wherein the conductive material is printed on the substrate.

* * * * *